US011789409B2

(12) United States Patent
Hata

(10) Patent No.: US 11,789,409 B2
(45) Date of Patent: Oct. 17, 2023

(54) CASE, TIMEPIECE AND FASTENING MEMBER

(71) Applicant: CASIO COMPUTER CO., LTD., Tokyo (JP)

(72) Inventor: Ryosuke Hata, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 162 days.

(21) Appl. No.: 17/387,015

(22) Filed: Jul. 28, 2021

(65) Prior Publication Data

US 2022/0035315 A1 Feb. 3, 2022

(30) Foreign Application Priority Data

Jul. 31, 2020 (JP) ..... 2020-130167

(51) Int. Cl.
*G04B 37/05* (2006.01)
*G04B 37/00* (2006.01)

(52) U.S. Cl.
CPC ..... *G04B 37/05* (2013.01); *G04B 37/0008* (2013.01)

(58) Field of Classification Search
CPC .. G04B 37/05; G04B 37/0008; G04B 37/084; G04B 37/052; G04B 37/225; G04B 37/00; G04B 17/08; G04G 17/02; G04G 17/083
See application file for complete search history.

(56) References Cited

U.S. PATENT DOCUMENTS 4,199,931 A * 4/1980 Yokoyama ..... G04G 17/02 968/878
4,291,400 A * 9/1981 Komiyama ..... G04G 17/02 968/878

(Continued)

FOREIGN PATENT DOCUMENTS

CN 205899263 U 1/2017
JP 2013099085 A 5/2013

(Continued)

OTHER PUBLICATIONS

Notice of Reasons for Refusal dated Jul. 20, 2022 received in Japanese Patent Application No. JP 2020-130167.

(Continued)

*Primary Examiner* — Edwin A. Leon
(74) *Attorney, Agent, or Firm* — SCULLY SCOTT MURPHY & PRESSER, PC

(57) ABSTRACT

An example case includes a case main body having a first insertion hole; a first exterior case having a second insertion hole coaxially corresponding to the first insertion hole and arranged on an upper part of the case main body; and a fastening member having a fixing portion to be fixed in the first insertion hole and a fitting portion to be fitted into the second insertion hole, the fitting portion being fitted into the second insertion hole while deforming a portion of the fitting portion to be fitted into the second insertion hole, wherein the fixing portion of the fastening member fixed in the first insertion hole includes a press fitting portion press-fitted into the first insertion hole, and wherein the press fitting portion of the fastening member includes a biting portion which bites into an inner circumferential surface of the first insertion hole of the case main body.

14 Claims, 7 Drawing Sheets

(56) References Cited

U.S. PATENT DOCUMENTS

| | | | | |
|---|---|---|---|---|
| 4,817,065 | A * | 3/1989 | Usui | G04G 17/08 968/878 |
| 8,777,794 | B2 | 7/2014 | Oishi | |
| 11,442,412 | B2 * | 9/2022 | Yasuda | G04G 17/02 |
| 2013/0109526 | A1 | 5/2013 | Oishi | |

FOREIGN PATENT DOCUMENTS

| | | | |
|---|---|---|---|
| JP | 2017-026418 | A | 2/2017 |
| JP | 6241759 | B2 | 12/2017 |

OTHER PUBLICATIONS

First Office Action dated Oct. 24, 2022 received in Chinese Patent Application No. CN 202110868157.6.

* cited by examiner

CASE, TIMEPIECE AND FASTENING MEMBER

CROSS-REFERENCE TO RELATED APPLICATION

This application is based upon and claims the benefit of priority from the prior Japanese Patent Application No. 2020-130167, filed Jul. 31, 2020, the entire contents of which are incorporated herein by reference.

BACKGROUND OF THE INVENTION

1. Field of the Invention

The present invention relates to a case for electronic devices such as wristwatches, a timepiece equipped with the case, and a fastening member.

2. Description of the Related Art

For example, a wristwatch case is known which has a structure where a first exterior member made of a flexible synthetic resin is arranged on the outer circumferential portion of a case main body made of a synthetic resin, a second exterior member made of metal is arranged on the upper part of the first exterior member, and screw members are screwed into fastening pipes in the case main body through second insertion holes in the second exterior member and first insertion holes in the first exterior member, whereby the first and second exterior members are attached to the case main body, as shown in Japanese Patent Application Laid-Open (Kokai) Publication No. 2017-026418.

SUMMARY

In accordance with one aspect of the present invention, there is provided a case comprising: a case main body which has a first insertion hole; a first exterior case which has a second insertion hole coaxially corresponding to the first insertion hole and is arranged on an upper part of the case main body; and a fastening member which has (i) a fixing portion to be fixed in the first insertion hole and (ii) a fitting portion to be fitted into the second insertion hole, wherein the fitting portion is fitted into the second insertion hole while deforming a portion of the fitting portion to be fitted into the second insertion hole, wherein the fixing portion of the fastening member which is fixed in the first insertion hole includes a press fitting portion which is press-fitted into the first insertion hole, and wherein the press fitting portion of the fastening member includes a biting portion which bites into an inner circumferential surface of the first insertion hole of the case main body.

In accordance with another aspect of the present invention, there is provided a timepiece comprising the above-described case.

In accordance with another aspect of the present invention, there is provided a fastening member comprising: a fixing portion which is fixed in a first insertion hole in a first component; and a fitting portion which is fitted into a second insertion hole that is provided in a second component to be arranged on an upper part of the first component while coaxially corresponding to the first insertion hole, wherein the fitting portion is fitted into the second insertion hole while deforming a portion of the fitting portion to be fitted into the second insertion hole, wherein the fixing portion includes a press fitting portion which is press-fitted into the first insertion hole, and wherein the press fitting portion has a tapered portion provided on a leading end thereof in an insertion direction toward the first insertion hole.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENT

Figure 1:
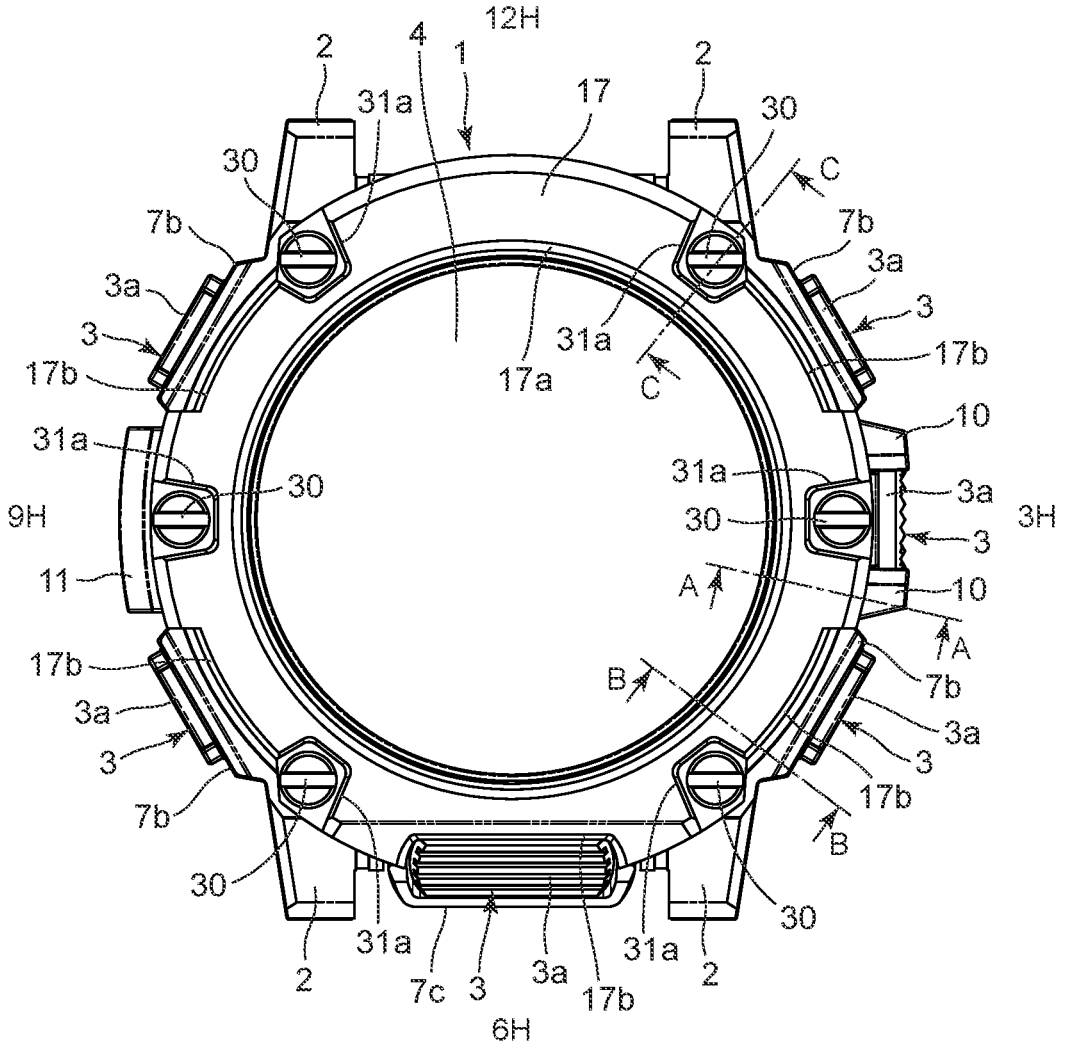
FIG. 1 is an enlarged front view of an embodiment where the present invention has been applied in a wristwatch.

An embodiment where the present invention has been applied in a wristwatch will hereinafter be described with reference to FIG. 1 to FIG. 7. This wristwatch has a wristwatch case 1, as shown in FIG. 1. On the twelve o'clock side and six o'clock side of the wristwatch case 1, band attachment sections 2 are provided to which watch bands (not shown) are attached.

Also, on portions of the wristwatch case 1 on the two o'clock side, the three o'clock side, the four o'clock side, the six o'clock side, the eight o'clock side, and the ten o'clock side, switch devices 3 are provided, as shown in FIG. 1. Among these switch devices 3, the switch devices 3 on the two o'clock side, the three o'clock side, the four o'clock side, the eight o'clock side, and the ten o'clock side are laterally oriented switches, and the switch device 3 on the six o'clock side is an upwardly oriented switch.

Figure 2:
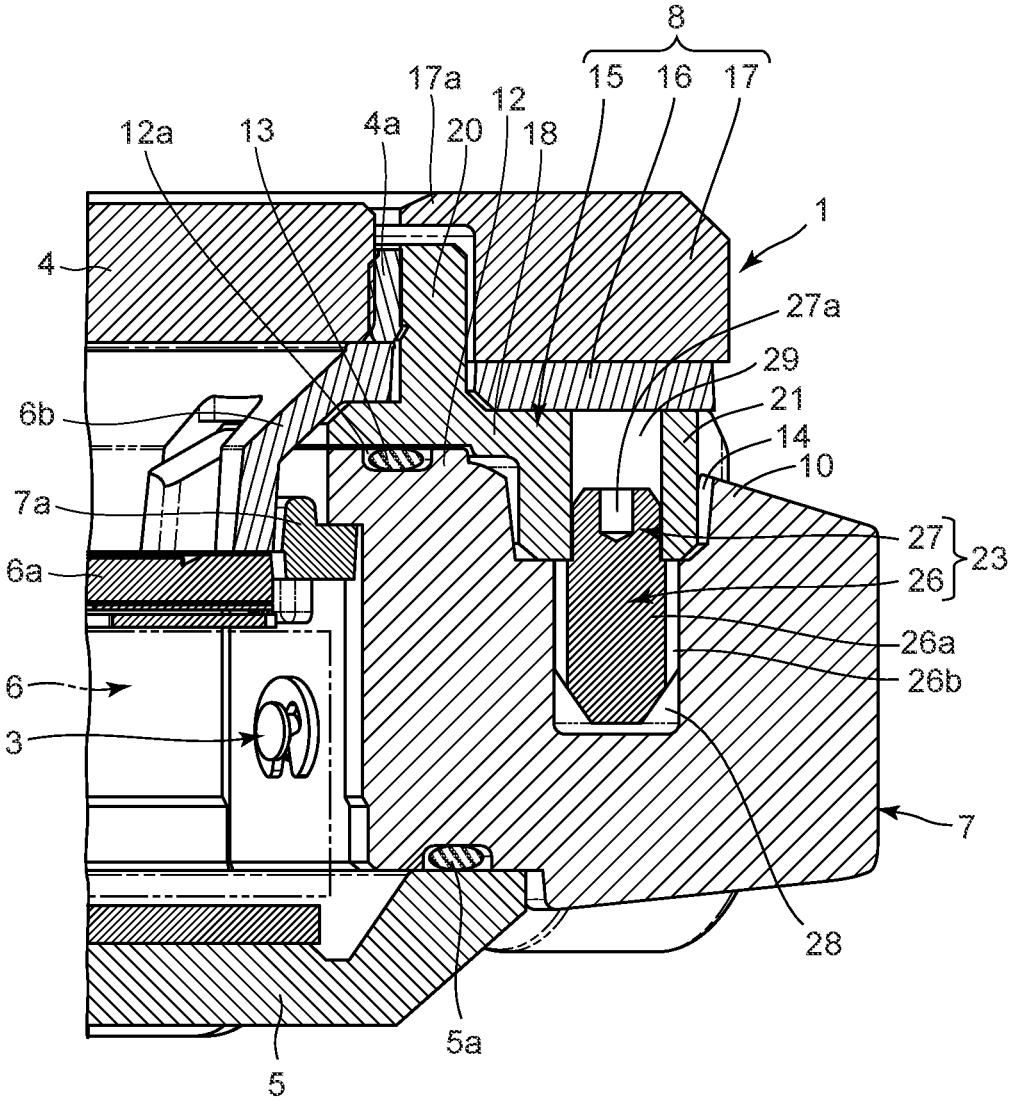
FIG. 2 is an enlarged cross-sectional view showing a main portion of the wristwatch taken along the A-A arrow view in FIG. 1.
Figure 3:
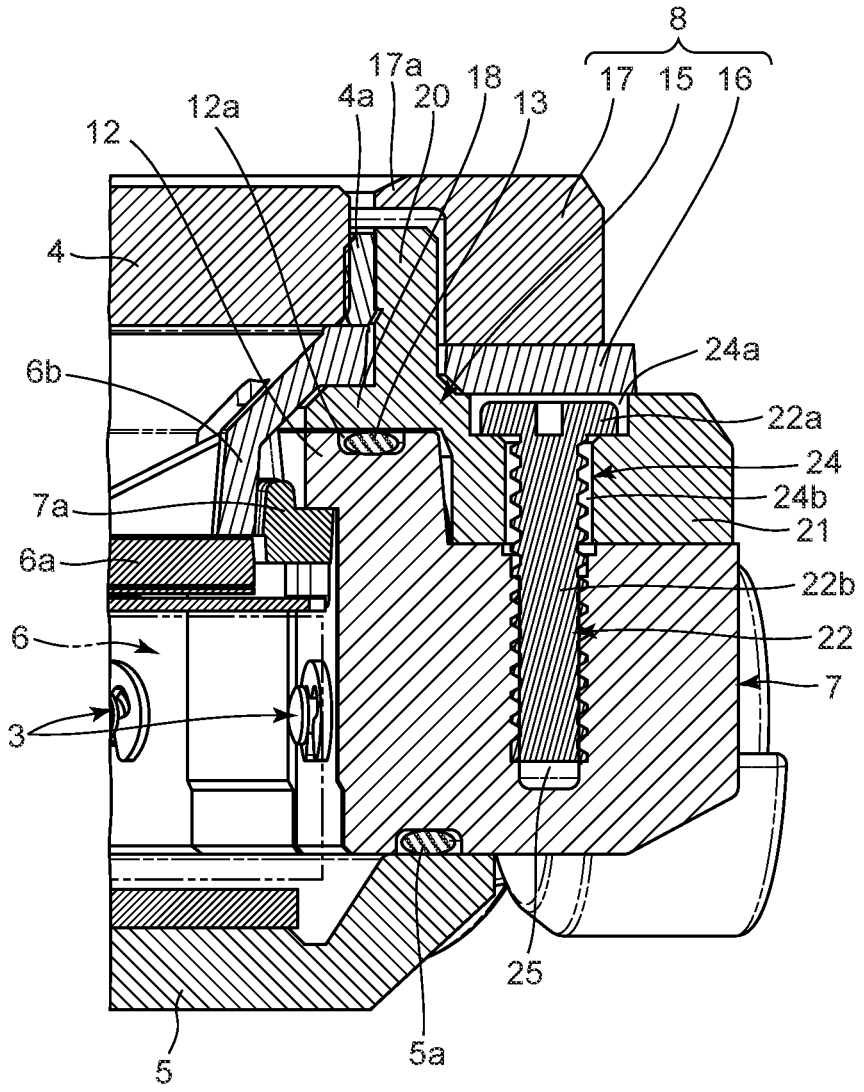
FIG. 3 is an enlarged cross-sectional view showing a main portion of the wristwatch taken along the B-B arrow view in FIG. 1.
Figure 4:
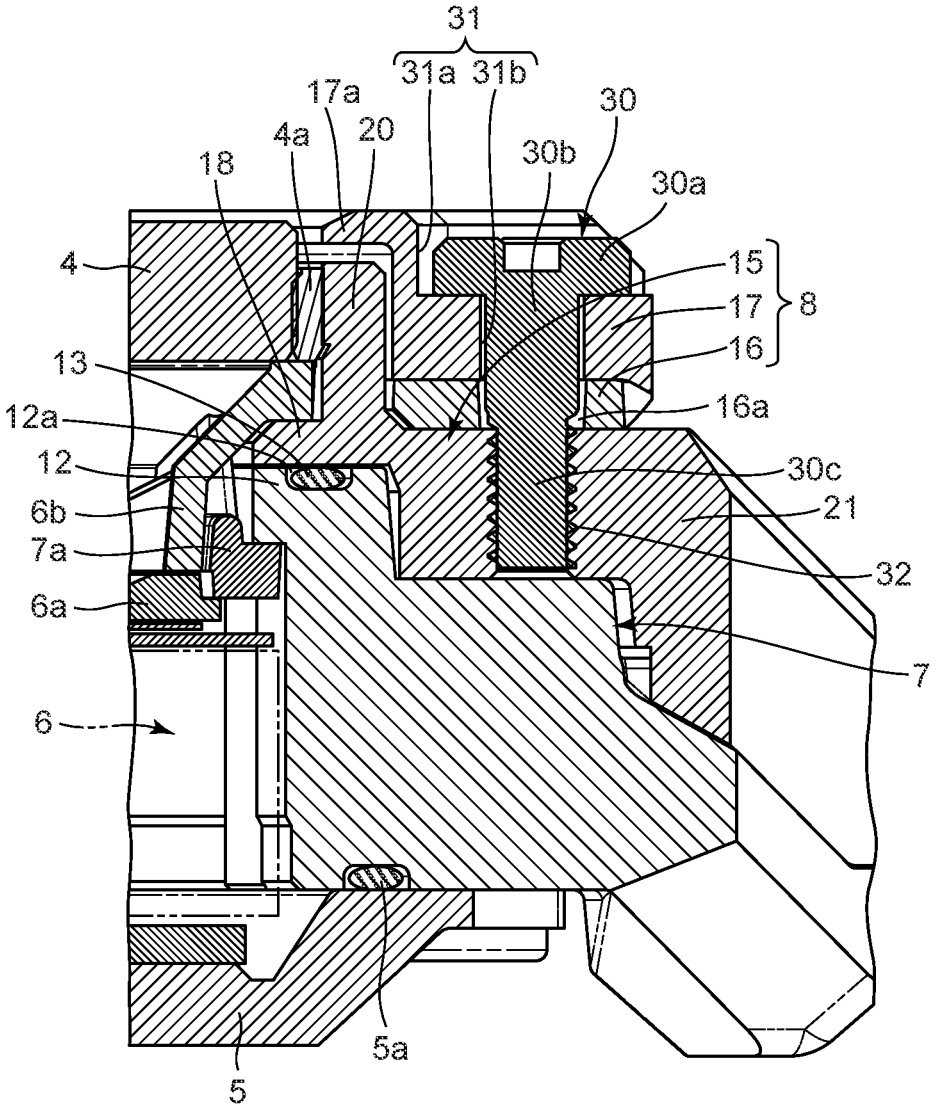
FIG. 4 is an enlarged cross-sectional view showing a main portion of the wristwatch taken along the C-C arrow view in FIG. 1.

Also, to the upper opening of the wristwatch case 1, a watch glass 4 is attached via a glass packing 4*a*, as shown in FIG. 2 to FIG. 4. On the lower part of the wristwatch case 1, a back cover 5 is attached via a waterproof packing 5*a*. Inside this wristwatch case 1, a timepiece module 6 is provided.

Although not shown in the drawings, this timepiece module 6 has various components necessary for timepiece functions, such as a timepiece movement for driving pointers to indicate the time, a display section for electrooptically displaying information including time information, and a circuit section for electrically controlling and driving them. On the upper surface of this timepiece module 6, a dial plate 6*a* is arranged, as shown in FIG. 2. On the upper surface side of the outer circumferential portion of the dial plate 6*a*, a parting member 6*b* is provided.

The wristwatch case 1 includes a case main body 7 and an exterior member 8, as shown in FIG. 1 to FIG. 4. The case main body 7 is a light-weight and high-strength member made of a material acquired by carbon fiber or glass fiber being mixed into a highly rigid polyamide resin. In the inner circumferential surface of this case main body 7, a metal reinforcement member 7*a* is embedded and a portion of which protrudes into an area inside the case main body 7.

Figure 5:
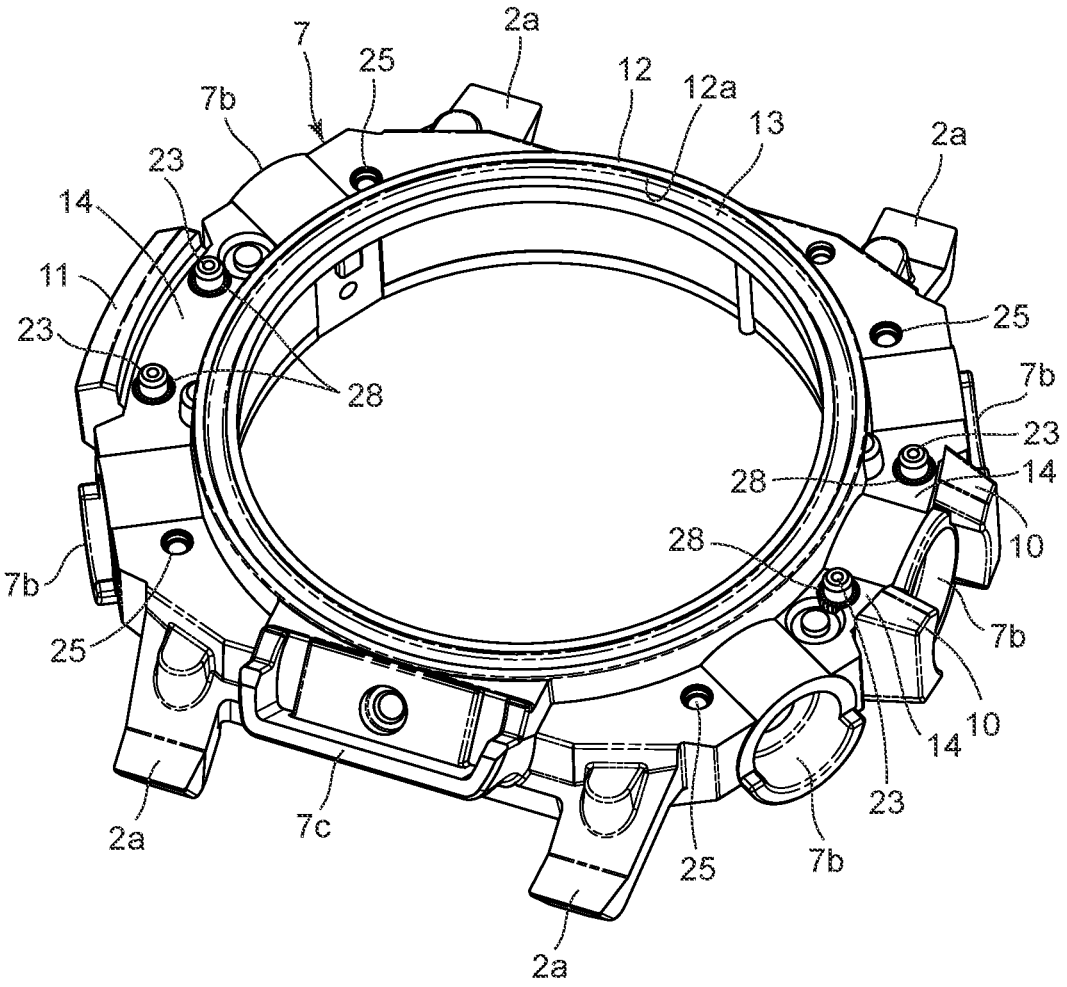
FIG. 5 is an enlarged perspective view of a case main body shown in FIG. 2.

The case main body 7 has a substantially ring shape as a whole, as shown in FIG. 5. On portions of this case main body 7 on the twelve o'clock side and the six o'clock side, body attachment sections 2*a* of the band attachment sections 2 are provided. Also, on portions of this case main body 7 on the two o'clock side, the three o'clock side, the four o'clock side, the eight o'clock side, and the ten o'clock side, first button housing recess sections 7*b* having a cylindrical shape are provided which house button head sections 3*a* of the switch devices 3 that are laterally oriented switches.

Each first button housing recess section 7*b* is provided such that its circumferential rim portion slightly protrudes from the outer circumferential surface of the case main body 7, as shown in FIG. 5. To the sides of the first button housing recess section 7*b* on the three o'clock side, protection covers 10 which protect side portions of the button head section 3*a* of the corresponding switch device 3 are provided to laterally and upwardly project outside the case main body 7.

On a portion of the case main body 7 on the six o'clock side, a second button housing recess section 7*c* having a quadrangle shape which houses the button head section 3*a* of the switch device 3 that is an upwardly oriented switch is provided to be open in the diagonally upward direction of the case main body 7, as shown in FIG. 5. Also, on a portion of the case main body 7 on the nine o'clock side, a decorative projection 11 is provided to laterally and upwardly project outside the case main body 7.

On the rim of an opening portion in the upper surface of the case main body 7, an upper surface projection 12 which has a ring shape and on which a later-described first exterior case 15 of the exterior member 8 is arranged is provided projecting upward, as shown in FIG. 5. The top surface of the upper surface projection 12 is a flat surface, and a packing groove 12*a* in which a waterproof packing 13 is circularly arranged is provided in this flat top surface.

In areas between the upper surface projection 12 and the two protection covers 10 on the three o'clock side, engaging recess sections 14 on the three o'clock side are provided, as shown in FIG. 2 and FIG. 5. Here, the upper surface projection 12 is formed slightly higher than the two protection covers 10 on the three o'clock side which project above the case main body 7 and, in this state, the engaging recess sections 14 on the three o'clock side are provided in the areas between the upper surface projection 12 and the two protection covers 10 on the three o'clock side.

Also, in an area between the upper surface projection 12 and the decorative projection 11 on the nine o'clock side, an engaging recess section 14 on the nine o'clock side which is similar to those on the three o'clock side is provided, as shown in FIG. 5. Here, the upper surface projection 12 is formed slightly higher than the decorative projection 11 on the nine o'clock side which projects above the case main body 7 and, in this state, the engaging recess section 14 on the nine o'clock side is provided in the area between the upper surface projection 12 and the decorative projection 11 on the nine o'clock side.

On the other hand, the exterior member 8 includes the first exterior case 15 which is arranged on the case main body 7 and a second exterior case 17 which is arranged on the first exterior case 15 via a spacer member 16, as shown in FIG. 1 to FIG. 4 and FIG. 6. The first exterior case 15 is made of a metal such as stainless steel which is more rigid than the case main body 7, and has a shape that is substantially the same as the outer shape of the upper surface of the case main body 7.

More specifically, the first exterior case 15 has a shape by which the upper ends of the two protection covers 10 on the three o'clock side, the upper end of the decorative projection 11 on the three o'clock side, and the second button housing recess section 7*c* on the six o'clock side are upwardly exposed in a planar view when this first exterior case 15 is arranged on the upper surface of the case main body 7, as shown in FIG. 2 to FIG. 4 and FIG. 6.

This first exterior case 15 includes an exterior main body 18 which is arranged on the upper surface of the case main body 7 and exterior attachment sections 2*b* which cover the body attachment sections 2*a* of the band attachment sections 2 on the case main body 7, as shown in FIG. 2 to FIG. 4 and FIG. 6. That is, each band attachment section 2 is constituted by the corresponding body attachment section 2*a* of the case main body 7 and the corresponding exterior attachment section 2*b* of the first exterior case 15.

On the upper surface of the exterior main body 18, a glass attachment section 20 having a ring shape is formed which projects upward and into which the watch glass 4 is fitted via the glass packing 4*a*, as shown in FIG. 2 to FIG. 4 and FIG. 6. As a result, the exterior main body 18 is structured such that, when this exterior main body 18 is arranged on the upper surface of the case main body 7, the undersurface thereof comes in pressure contact with the waterproof packing 13 arranged in the packing groove 12*a* of the upper surface projection 12 of the case main body 7, whereby waterproofing between the case main body 7 and the first exterior case 15 is achieved.

Also, on outer circumferential portions of the undersurface of the exterior main body 18, a plurality of reinforcement projections 21 each having a substantially ring shape is provided projecting toward the upper surface of the case main body 7, and each of which is arranged on the upper surface of the case main body 7, as shown in FIG. 2 to FIG. 4. Some of these reinforcement projections 21 are structured to be positioned in the two engaging recess sections 14 of the case main body on the three o'clock side and the engaging recess section 14 on the nine o'clock side when they are arranged on the upper surface of the case main body 7.

On the other hand, the second exterior case 17 is made of a highly rigid metal such as stainless steel and has a substantially ring shape, as shown in FIG. 1 to FIG. 4. This second exterior case 17 is structured to be arranged on the upper surface of the first exterior case 15 via the spacer member 16 and positioned around the outer circumference of the glass attachment section 20 of the first exterior case 15.

That is, the inner diameter of the second exterior case 17 is substantially equal to the outer diameter of the glass attachment section 20 of the first exterior case 15, and the outer diameter thereof is substantially equal to the outer diameter of the first exterior case 15, as shown in FIG. 1 to FIG. 4. In addition, the length (thickness) of the second exterior case 17 in the vertical direction is substantially equal to the length (height) of the glass attachment section 20 of the first exterior case 15 in the vertical direction.

As a result, the second exterior case 17 is structured such that, when this second exterior case 17 is arranged on the first exterior case 15 via the spacer member 16, the upper part thereof projects above the glass attachment section 20 of the first exterior case 15 by a length equal to the thickness of the spacer member 16, as shown in FIG. 2 to FIG. 4. On the upper inner circumferential surface of the second exterior case 17, a brim section 17*a* which covers the upper surface of the glass attachment section 20 is provided.

Also, in plural outer circumferential portions of this second exterior case 17 on the two o'clock side, the four o'clock side, the six o'clock side, the eight o'clock side, and the ten o'clock side, cutout sections 17*b* are provided, as shown in FIG. 1. The cutout sections 17*b* on the two o'clock side, the four o'clock side, the eight o'clock side, and the ten o'clock side are provided in the second exterior case 17 such that the outer ends of the first button housing recess sections 7*b* on the two o'clock side, the four o'clock side, the eight o'clock side, and the ten o'clock side are exposed. In addition, the cutout section 17*b* on the six o'clock side is provided in the second exterior case 17 such that the button head section 3*a* of the switch device 3 arranged in the second button housing recess section 7*c* on the six o'clock side is exposed.

The spacer member 16 is made of a flexible synthetic resin such as urethane resin and has a ring shape, as shown in FIG. 2 to FIG. 4. This spacer member 16 is formed such that its cross-sectional shape is a substantially rectangular plate shape. The inner diameter of this spacer member 16 is substantially equal to the outer diameter of the glass attachment section 20, and the outer diameter thereof is slightly shorter than the outer diameter of the second exterior case 17. As a result, the spacer member 16 is structured to be held between the first exterior case 15 and the second exterior case 17, and thereby covered by the second exterior case 17 so as not to be seen from outside.

The first exterior case 15 is attached to the case main body 7 by a plurality of first screw members 22 and a plurality of fastening members 23, as shown in FIG. 2 and FIG. 3. The plurality of first screw members 22 is structured to be screwed into first screw holes 25 in the case main body 7 through first screw attachment holes 24 in the first exterior case 15 so as to attach the first exterior case 15 to the case main body 7.

Figure 6:
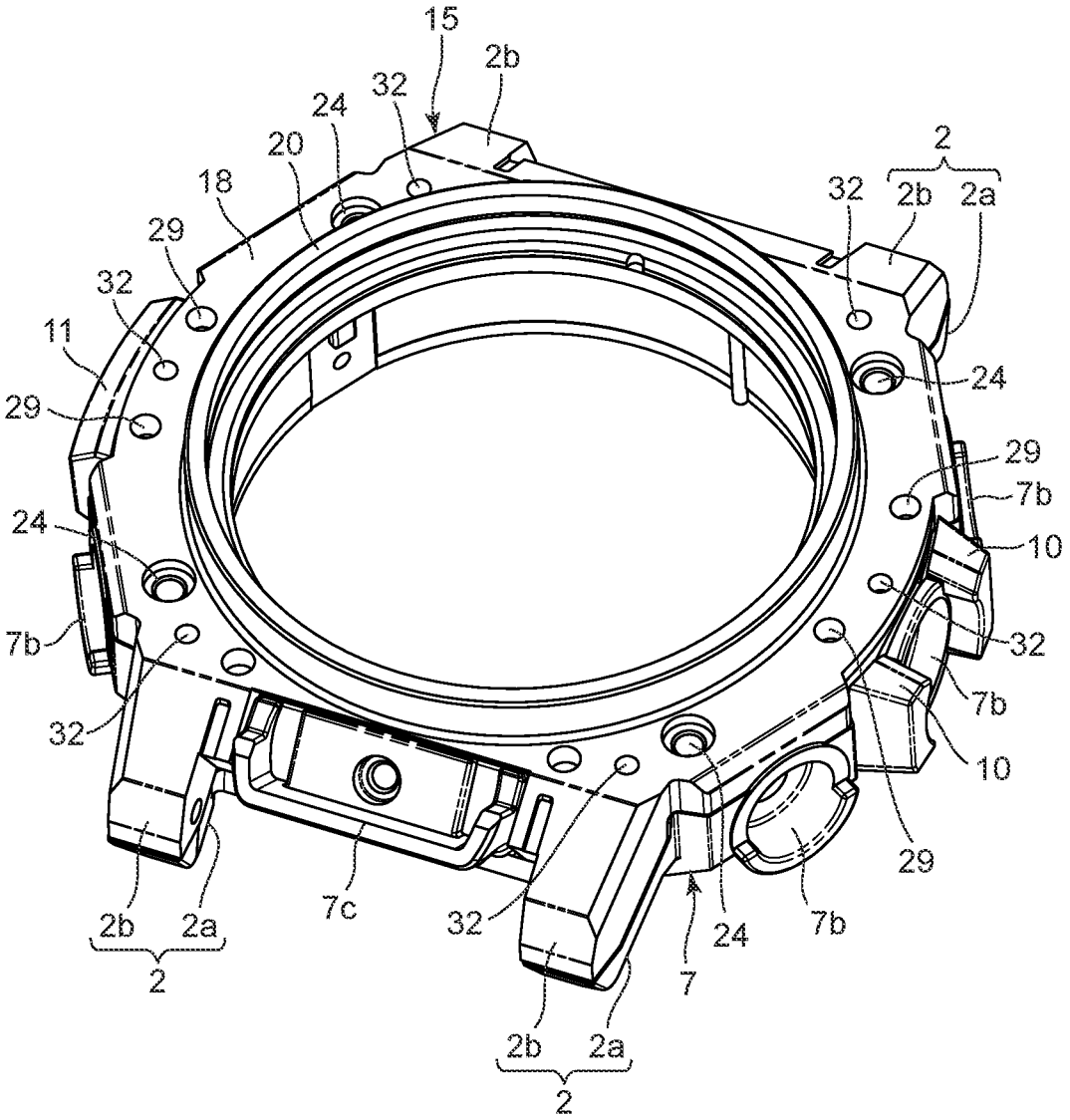
FIG. 6 is an enlarged perspective view showing a state where a first exterior case has been attached to the case main body of FIG. 5.

The first screw attachment holes 24 are provided in four portion of the first exterior case 15 on the one o'clock side, the five o'clock side, the seven o'clock side, and the eleven o'clock side, as shown in FIG. 6. Also, the first screw holes 25 are provided in four portion of the case main body 7 on the one o'clock side, the five o'clock side, the seven o'clock side, and the eleven o'clock side while coaxially corresponding to the first screw attachment holes 24 of the first exterior case 15, as shown in FIG. 5.

More specifically, each first screw attachment hole 24 is provided in the corresponding reinforcement projection 21 of the first exterior case 15 and includes a large diameter hole section 24*a* in which a head section 22*a* of the corresponding first screw member 22 is arranged, and a small diameter hole section 24*b* into which a screw section 22*b* of the first screw member 22 is inserted, as shown in FIG. 3. The large diameter hole section 24*a* of this first screw attachment hole 24 is formed such that its inner diameter is greater than the outer diameter of the head section 22*a* of the first screw member 22 and its length in the axial direction is longer than that of the head section 22*a*.

In other words, the head section 22*a* of the first screw member 22 is structured to be arranged in the large diameter hole section 24*a* such that its outer circumferential surface is arranged spaced apart from the inner circumferential surface of the large diameter hole section 24*a* and its upper surface does not protrude from and above the large diameter hole section 24*a*, as shown in FIG. 3. That is, the head section 22*a* of the first screw member 22 is structured not to come in contact with the spacer member 16 when the spacer member 16 is arranged on the first exterior case 15.

The inner diameter of the small diameter hole section 24*b* of the first screw attachment hole 24 is greater than the outer diameter of the screw section 22*b* of the first screw member 22, and the length of the small diameter hole section 24*b* in the axial direction is shorter than that of the screw section 22*b*, as shown in FIG. 3. As a result, the screw section 22*b* of the first screw member 22 is structured to be inserted into the small diameter hole section 24*b* and protrude from and under the small diameter hole section 24*b* without coming in contact with the inner circumferential surface of the small diameter hole section 24*b* by having a space therebetween.

On the inner circumferential surface of each first screw hole 25 in the case main body 7, a female thread is provided with which the screw section 22*b* of the corresponding first screw member 22 is engaged, as shown in FIG. 3. The lengths of the first screw holes 25 in the axial direction are longer than those of the first screw attachment holes 24 and shorter than those of the screw sections 22*b*. Each first screw hole 25 is structured such that the screw section 22*b* of the corresponding first screw member 22 is screwed thereinto through the small diameter hole section 24*b* of the corresponding first screw attachment hole 24 with the head section 22*a* of the first screw member 22 being arranged in the large diameter hole section 24*a* of the first screw attachment hole 24.

Also, each first screw member 22 is structured such that the leading end of its screw section 22*b* does not come in contact with the lower end of the corresponding first screw hole 25 of the case main body 7 when its head section 22*a* is arranged in the large diameter hole section 24*a* of the corresponding first screw attachment hole 24 and the screw section 22*b* is screwed into the first screw hole 25 through the small diameter hole section 24*b* of the first screw attachment hole 24 and tightened, as shown in FIG. 3.

On the other hand, the fastening members 23 each include a fixing portion 26 which is fixed in one of a plurality of first insertion holes 28 in the case main body 7, and a fitting portion 27 which is fitted into one of a plurality of second insertion holes 29 in the first exterior case 15, as shown in FIG. 2, FIG. 5, FIG. 6, and FIG. 7. The first insertion holes 28 are provided in four portions of side parts of the case main body 7 on the three o'clock side and the nine o'clock side, as shown in FIG. 5.

More specifically, these first insertion holes 28 are provided in four portions including two portions corresponding to the two protection covers 10 provided on the side part of the case main body 7 on the three o'clock side and two portions corresponding to the sides of the decorative projection, which is provided on the side part of the case main body 7 on the nine o'clock side, in the circumferential direction of the case main body 7, as shown in FIG. 5. Also, the second insertion holes 29 are provided in four portions of side parts of the first exterior case 15 on the three o'clock side and the nine o'clock side while coaxially corresponding to the first insertion holes 28, as shown in FIG. 6.

Figure 7A:
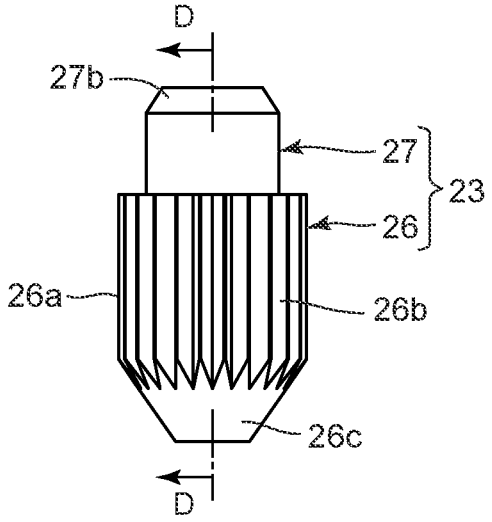
FIG. 7A is an enlarged front view of a fastening member shown in FIG. 2.
Figure 7B:
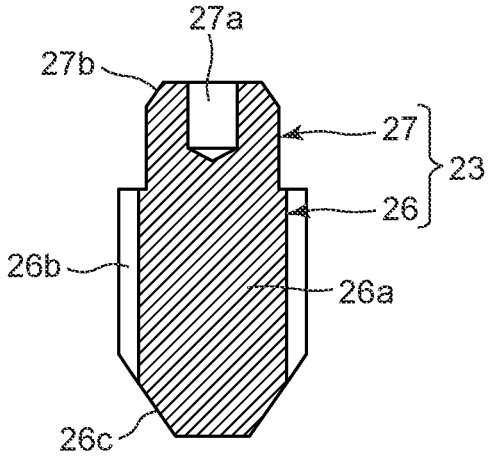
FIG. 7B is an enlarged cross-sectional view of the fastening member taken along the D-D arrow view in FIG. 7A.
Figure 7C:
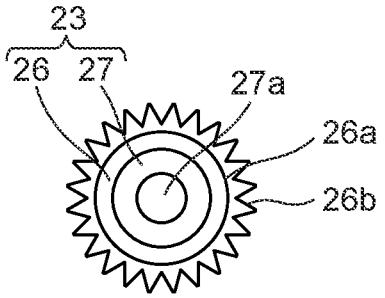
FIG. 7C is an enlarged planar view of the fastening member shown in FIG. 7A.

Each fastening member 23 is formed such that the outer diameter of its fixing portion 26 is greater than the outer diameter of its fitting portion 27, as shown in FIG. 2 and FIG. 7. More specifically, the fixing portion 26 includes a press fitting portion 26*a* which is press-fitted into the corresponding first insertion hole 28. On the outer circumferential surface of this press fitting portion 26*a*, a biting section 26*b* is provided which bites into the inner circumferential surface of the first insertion hole 28 of the case main body 7. This biting section 26*b* is a knurled section which bites into the inner circumferential surface of the first insertion hole 28 of the case main body 7, and has a structure where a number of peak portions and a number of valley portions extending in the axis direction have been alternately formed by knurling.

Accordingly, the press fitting portion 26*a* is structured to be pressed into the first insertion hole 28 with a number of projections of the biting section 26*b* biting into the inner circumferential surface of the first insertion hole 28 of the case main body 7, and thereby press-fitted into and attached to the first insertion hole 28 without rattling in the direction perpendicular to the axial direction, as shown in FIG. 2. On the lower part of the press fitting portion 26*a*, a tapered section 26*c* by which this press fitting portion 26*a* can be easily pressed into the first insertion hole 28 of the case main body 7 is formed at an inclination angle of about 35 degrees, as shown in FIG. 7.

The fitting portion 27 of this fastening member 23 is structured to be fitted into the corresponding second insertion hole 29 of the first exterior case 15 while deforming its portion to be fitted thereinto, as shown in FIG. 2 and FIG. 7. This fitting portion 27 is formed such that its length in the radial direction after the insertion into the second insertion hole 29 is shorter than that before the insertion.

More specifically, in the fitting portion 27, a hollow section 27*a* is provided which enables this fitting portion 27 to be press-deformed when fitted into the second insertion hole 29 of the first exterior case 15, as shown in FIG. 2 and FIG. 7. This hollow section 27*a* is a hole provided in the center of the upper surface of the fitting portion 27 and extending in the axial direction from the upper surface, and its inner diameter has a size enabling the fitting portion 27 to be press-deformed.

The length (depth) of the hollow section 27*a* in the axial direction is only required to be between the length of the fitting portion 27 in the axial direction and about half the length thereof. However, it should preferably be about ⅔ of the length of the fitting portion 27 in the axial direction, as shown in FIG. 2 and FIG. 7. Also, on the outer circumferential portion of the upper end of the fitting portion 27, a chamfered section 27*b* is provided by which the fitting portion 27 can be easily fitted into the second insertion hole 29 of the first exterior case 15.

On the other hand, the inner diameter of the first insertion hole 28 of the case main body 7 is shorter than the outer diameter of the press fitting portion 26*a* of the fastening member 23 by a length equal to the biting of the biting section 26*b* with respect to the inner circumferential surface of the first insertion hole 28, as shown in FIG. 2. That is, the first insertion hole 28 is structured such that the biting section 26*b* of the press fitting portion 26*a* bites into the inner circumferential surface thereof and the press fitting portion 26*a* is press-fitted into the case main body 7, whereby the press fitting portion 26*a* in the first insertion hole 28 does not rattle in the direction perpendicular to the axial direction of the fastening member 23.

The inner diameter of the second insertion hole 29 of the first exterior case 15 is equal to the outer diameter of the fitting portion 27 of the fastening member 23, and no fitting tolerance exists between the second insertion hole 29 and the fitting portion 27, that is, the fitting tolerance therebetween is 0 (zero), as shown in FIG. 2. As a result, the fitting portion 27 of the fastening member 23 is structured such that, when fitted into the second insertion hole 29 of the first exterior case 15, this fitting portion 27 in the second insertion hole 29 does not rattle in the direction perpendicular to the axial direction of the fastening member 23.

That is, the fitting portion 27 of the fastening member 23 is structured such that, even if the axial center of the press fitting portion 26*a* press-fitted into and attached to the first insertion hole 28 of the case main body 7 and the axial center of the second insertion hole 29 of the first exterior case 15 are at positions shifted from each other when the fitting portion 27 is fitted into the second insertion hole 29 of the first exterior case 15, the fitting portion 27 is fitted into the second insertion hole 29 while being press-deformed in proportion to this position deviation, as shown in FIG. 2 and FIG. 7. As a result of this structure, the fitting portion 27 is fitted into the second insertion hole 29 with its outer circumferential surface being in close contact with the inner circumferential surface of the second insertion hole 29.

The second exterior case 17 is attached to the first exterior case 15 via the spacer member 16 by a plurality of second screw members 30, as shown in FIG. 1 and FIG. 4. Each of these screw members 30 is structured to be screwed into one of a plurality of second screw holes 32 in the first exterior case 15 through one of a plurality of second screw attachment holes 31 in the second exterior case 17 and one of a plurality of insertion holes 16*a* in the spacer member 16 so as to attach the second exterior case 17 to the first exterior case 15.

The second screw attachment holes 31 are provided in six portions of the second exterior case 17 on the one o'clock side, the three o'clock side, the five o'clock side, the seven o'clock side, the nine o'clock side, and the eleven o'clock side, as shown in FIG. 1 and FIG. 4. Also, the second screw holes 32 are provided in six portions of the first exterior case 15 on the one o'clock side, the three o'clock side, the five o'clock side, the seven o'clock side, the nine o'clock side, and the eleven o'clock side while coaxially corresponding to the second screw attachment holes 31 of the second exterior case 17, as shown in FIG. 6.

Each second screw attachment hole 31 includes a cutout recess section 31*a* where a head section 30*a* of the corresponding second screw member 30 is arranged, and a hole section 31*b* into which a neck section 30*b* of the second screw member 30 is inserted, as shown in FIG. 4. The length (depth) of the cutout recess section 31*a* of this second screw attachment hole 31 in the axial direction is longer (deeper) than the length of the head section 30*a* in the axial direction.

That is, the second screw member 30 is structured such that the head section 30*a* is arranged with a space between its outer circumferential surface and the inner circumferential surface of the cutout recess section 31*a*, and the upper surface of the head section 30*a* is positioned in the cutout recess section 31*a* without protruding from and above the cutout recess section 31*a*, as shown in FIG. 1 and FIG. 4. As a result, the head section 30*a* of the second screw member 30 is structured to be exposed to the outside of the second exterior case 17.

The hole section 31*b* of the second screw attachment hole 31 is formed such that its inner diameter is greater than the outer diameter of the neck section 30*b* of the second screw member 30, and its length in the axial direction is shorter than that of the neck section 30*b* and longer than that of the head section 30*a*, as shown in FIG. 4. As a result, the neck section 30*b* of the second screw member 30 is structured to be inserted into the hole section 31*b* and protrude from and under the second exterior case 17 without coming in contact with the inner circumferential surface of the hole section 31*b* by having a space therebetween.

In the spacer member 16, each insertion hole 16*a* is a hole into which the lower part of the neck section 30*b* of the corresponding second screw member 30 is inserted, and the inner diameter of this insertion hole 16*a* is equal to or slightly greater than that of the hole section 31*b* of the corresponding second screw attachment hole 31, as shown in FIG. 4. Accordingly, the neck section 30*b* of the second screw member 30 is structured to be inserted into the insertion hole 16*a* of the spacer member 16 with a space between it and the inner circumferential surface of the insertion hole 16*a*. The length of the neck section 30*b* of the second screw member 30 in the axial direction is slightly shorter than the total length of the hole section 31*b* of the second screw attachment hole 31 and the insertion hole 16*a* of the spacer member 16 in the axial direction.

That is, the second screw member 30 is structured such that, when its head section 30*a* is arranged in the cutout recess section 31*a* of the second screw attachment hole 31 of the second exterior case 17 and its neck section 30*b* is inserted into and tightened in the hole section 31*b* of the second screw attachment hole 31 and the insertion hole 16*a* of the spacer member 16, the lower end of the neck section 30*b* does not protrude from and under the insertion hole 16*a* of the spacer member 16 so as not to come in contact with the first exterior case 15, as shown in FIG. 4.

On the inner circumferential surface of each second screw hole 32 of the first exterior case 15, a female thread is provided with which a screw section 30*c* of the corresponding second screw member 30 is engaged, as shown in FIG. 4. Here, the length of the second screw hole 32 in the axial direction is longer than that of the screw section 30*c* of the second screw member 30. As a result, the second screw hole 32 is structured such that, when the screw section 30*c* of the second screw member 30 is tightened with the head section 30*a* of the second screw member 30 being arranged in the corresponding cutout recess section 31*a* of the second exterior case 17, the leading end of the second screw section 30*c* does not protrude from the lower end of the second screw hole 32.

Next, an assembly procedure for this wristwatch is described.

In the assembly, first, the first exterior case 15 is attached to the case main body 7. Here, before this attachment, the waterproof packing 13 is attached to the packing groove 12*a* in the upper surface projection 12 of the case main body 7, and the plurality of fastening members 23 is attached to the plurality of first insertion holes 28 provided in the two portions of the case main body 7 on the one o'clock side and the five o'clock side and the two portions thereof on the seven o'clock side and the eleven o'clock side.

When the fastening members 23 are to be attached to the first insertion holes 28 of the case main body 7, the press fitting portions 26*a* of the fixing portions 26 of the fastening members 23 are pressed into the first insertion holes 28 of the case main body 7, whereby the fixing portions 26 are fixed in the first insertion holes 28. Here, the inner diameter of each first insertion hole 28 of the case main body 7 is shorter than the outer diameter of each press fitting portion 26*a* by a length equal to the biting of the biting section 26*b* of each press fitting portion 26*a*. Accordingly, the fastening members 23 are pressed with the tapered sections 26*c* of the press fitting portions 26*a* being inserted and positioned in the first insertion holes 28 of the case main body 7.

As a result, the biting sections 26*b* of the press fitting portions 26*a* are gradually pressed while biting into the inner circumferential surfaces of the first insertion holes 28 of the case main body 7. That is, since each biting section 26*b* is a knurled section in which a number of peak portions and a number of valley portions extending in the axis direction have been alternately formed, each press fitting portion 26*a* is pressed into the corresponding first insertion hole 28 while causing these peak portions to bite into the inner circumferential surface of the first insertion hole 28. As a result, these press fitting portions 26*a* are pressed into the first insertion holes 28 without rattling in the radial direction perpendicular to the axial direction, whereby the fastening members 23 are attached to the first insertion holes 28.

In this state, the parting member 6*b* is inserted into and arranged in the first exterior case 15 from above, and the watch glass 4 and the glass packing 4*a* are fitted into the glass attachment section 20 of the first exterior case 15. Then, the exterior main body 18 of the first exterior case 15 is arranged on the case main body 7 such that the exterior attachment sections 2*b* of the first exterior case 15 on the twelve o'clock side and the six o'clock side are arranged covering the body attachment sections 2*a* of the case main body 7 on the twelve o'clock side and the six o'clock side.

Here, the reinforcement projections 21 provided on the three o'clock side and nine o'clock side of the exterior main body 18 of the first exterior case 15 are arranged in the engaging recess sections 14 of the case main body 7 on the three o'clock side and the nine o'clock side such that the plurality of second insertion holes 29 provided in these reinforcement projections 21 corresponds to the fitting portions 27 of the plurality of fastening members 23 attached to the case main body 7 and the plurality of first screw attachment holes 24 provided in the other reinforcement projections 21 corresponds to the plurality of first screw holes 25 provided in the case main body 7.

In this state, the plurality of first screw members 22 is screwed into and attached to the plurality of first screw holes 25 of the case main body 7 through the plurality of first screw attachment holes 24 in the reinforcement projections 21 of the first exterior case 15, and the fitting portions 27 of the plurality of fastening members 23 attached to the case main body 7 are fitted into the plurality of second insertion holes 29 in the reinforcement projections 21 of the first exterior case 15.

When the plurality of first screw members 22 inserted into the plurality of first screw attachment holes 24 of the first exterior case 15 are screwed into the plurality of first screw holes 25 of the case main body 7 and tightened as described above, the head sections 22*a* of the first screw members 22 are arranged in the large diameter hole sections 24*a* of the first screw attachment holes 24, and the screw sections 22*b* of the first screw members 22 are screwed into the first screw holes 25 of the case main body 7 through the small diameter hole sections 24*b* of the first screw attachment holes 24 and tightened. As a result, the first exterior case 15 is pressed against and attached to the case main body 7.

Along with this attachment, the fitting portions 27 of the plurality of fastening members 23 are pressed and fitted into the second insertion holes 29 of the first exterior case 15. Here, the inner diameter of each second insertion hole 29 is equal to the outer diameter of the corresponding fitting portion 27, that is, the fitting tolerance between each second insertion hole 29 and the corresponding fitting portion 27 is 0 (zero). Accordingly, the fitting portions 27 are fitted into the second insertion holes 29 of the first exterior case 15 while being guided by their chamfered sections 27*b*.

As described above, when the fitting portions 27 are to be fitted into the second insertion holes 29 of the first exterior case 15, the outer circumferential surface of each fitting portion 27 and the inner circumferential surface of the corresponding second insertion hole 29 come in close contact with each other. Accordingly, the first exterior case 15 does not rattle in the direction perpendicular to the axial direction of the fastening members 23.

That is, if the axis center of the press fitting portion 26*a* of each fixing portion 26 press-fitted into and attached to the first insertion holes 28 of the case main body 7 and the axis center of the corresponding second insertion hole 29 of the first exterior case 15 are at positions shifted from each other when the fitting portions 27 are fitted into the second insertion holes 29 of the first exterior case 15, each fitting portion 27 is fitted into the corresponding second insertion hole 29 while being guided by its chamfered section 27*b* and being press-deformed by the presence of its hollow section 27*a* in proportion to the position deviation between the axis centers.

Here, the length of each fitting portion 27 in the radial direction after it is fitted into the corresponding second insertion hole 29 is shorter than that before it is fitted into this second insertion hole 29. That is, the outer circumferential surface of each fitting portion 27 comes in close contact with the inner circumferential surface of the corresponding second insertion hole 29. As a result, the fitting portions 27 are fitted into the second insertion holes 29 without rattling in the direction perpendicular to the axial direction of the fastening members 23.

In addition, the exterior main body 18 of the first exterior case 15 is pressed against the upper surface projection 12 of the case main body 7 and thereby pressed against and brought into pressure contact with the waterproof packing 13 provided in the packing groove 12*a* of the upper surface projection 12. As a result, waterproofing between the case main body 7 and the first exterior case 15 is achieved. Moreover, the exterior attachment sections 2*b* of the first exterior case 15 are arranged to be overlaid on the body attachment sections 2*a* of the case main body 7, whereby the band attachment sections 2 are formed.

In this state, the second exterior case 17 and the spacer member 16 are attached to the first exterior case 15. In this attachment, first, the spacer member 16 is arranged on the upper surface of the first exterior case 15, and then the second exterior case 17 is arranged on the spacer member 16. As a result, the brim section 17*a* of the second exterior case 17 is arranged covering the glass attachment section 20 of the first exterior case 15.

In this state, the plurality of second screw attachment holes 31 of the second exterior case 17 and the plurality of insertion holes 16*a* of the spacing member 16 are placed corresponding to the plurality of second screw holes 32 of the first exterior case 15, and the second exterior case 17 is attached to the first exterior case 15 by the plurality of second screw members 30. Here, the second screw members 30 are inserted into the insertion holes 16*a* of the spacing member 16 through the second screw attachment holes 31 of the second exterior case 17, and screwed into and tightened in the second screw holes 32 of the first exterior case 15.

Consequently, the head sections 30*a* of the second screw members 30 are arranged in the cutout recess sections 31*a* of the second screw attachment holes 31 of the second exterior case 17, the neck sections 30*b* are inserted into the hole sections 31*b* of the second screw attachment hole 31 and the insertion holes 16*a* of the spacer member 16, and the second screw sections 30*c* are screwed into the second screw holes 32. These head sections 30*a* of the second screw members 30 press the second exterior case 17 and the spacer member 16 against the first exterior case 15, whereby the second exterior case 17 is attached to the first exterior case 15 together with the spacer member 16. As a result, the assembly of the wristwatch case 1 is completed.

Then, the plurality of switch devices 3 is attached to the case main body 7. Here, the button head sections 3*a* of the switch devices 3 that are laterally oriented switches are housed and arranged in the first button housing recess sections 7*b* provided in the side portions of the case main body 7 on the two o'clock side, the three o'clock side, the four o'clock side, the eight o'clock side, and the ten o'clock side. Also, in the second button housing recess section 7*c* provided on the six o'clock side of the case main body 7, the button head section 3*a* of the switch device 3 that is an upwardly oriented switch is housed and arranged.

In this state, the timepiece module 6 is inserted into and arranged in the case main body 7 from below. Here, first, the dial plate 6*a* is arranged on the upper surface of the timepiece module 6, and this timepiece module 6 with the dial plate 6*a* is inserted into the case main body 7 and arranged therein with the outer circumferential portion of the upper surface of the dial plate 6*a* being pressed against the undersurface of the parting member 6*b*. Then, the back cover 5 is attached to the lower part of the case main body 7 together with the waterproof packing 5*a*. As a result, the assembly of the wristwatch is completed.

Next, the mechanism of this wristwatch is described. In a normal state, this wristwatch displays information of various functions, such as information regarding a time of day, a date, and a day of the week, by the timepiece module 6 mounted in the wristwatch case 1. Also, these various functions, such as a time correction function, are switched by operations on the plurality of switch devices 3 provided on the wristwatch case 1.

In the case of the above-described conventional wristwatch case, since the screw members to be screwed into the fastening pipes in the case main body are inserted into the second insertion holes of the second exterior member and the first insertion holes of the first exterior member, the inner diameter of each of the first and second insertion holes is required to be greater than the outer diameter of each screw member by a length equal to a fitting tolerance therebetween. As a result, a gap is formed between the inner circumferential surface of each of the first and second insertion holes and the outer circumferential surface of the corresponding screw member.

Accordingly, when this type of wristwatch case is subjected to an external impact, the first and second exterior members rattle and their positions with respect to the case main body are shifted due to the presence of gaps formed by each fitting tolerance between the inner circumferential surface of each of the first and second insertion holes and the outer circumferential surface of the corresponding screw member. Thus, this wristwatch case has a problem in that loads resulting from these position deviations are applied to the case main body made of a synthetic resin via the screw members, which may cause the case main body to be damaged.

In the case of the present invention, even if the wristwatch case 1 is subjected to an external impact, the first exterior case 15 does not rattle with respect to the case main body 7, whereby the case main body 7 is prevented from being damaged by rattling. More specifically, here, the press fitting portion 26*a* of each metal fastening member 23 has been press-fitted into the corresponding first insertion hole 28 with the biting section 26*b* of each press fitting portion 26*a* biting into the inner circumferential surface of the corresponding first insertion hole 28 in the case main body 7 made of a synthetic resin, and the fitting portion 27 of each fastening member 23 has been fitted into the corresponding second insertion hole 29 of the metal first exterior case 15 with it being press-deformed.

That is, each fastening member 23 is in a state where its press fitting portion 26*a* has been fitted into the corresponding first insertion hole 28 of the case main body 7 without rattling in the direction perpendicular to the axial direction of this fastening member 23, and its fitting portion 27 has been fitted into the corresponding second insertion hole 29 of the first exterior case 15 without rattling in this direction.

As a result, even if the wristwatch case 1 is subjected to an external impact, the position of the first exterior case 15 with respect to the case main body 7 is not shifted in the direction perpendicular to the axial direction of the fastening members 23. As a result of this structure, loads resulting from the position deviation of the first exterior case 15 are not applied to the case main body 7 via the fastening members 23, whereby the case main body 7 is prevented from being damaged and its impact resistance is enhanced.

In particular, each first insertion hole 28 of the case main body 7 made of a synthetic resin is formed such that its inner diameter is shorter than the outer diameter of the press fitting portion 26*a* of each metal fastening member 23 by a length equal to the biting of the biting section 26*b* of the press fitting portion 26*a*. Accordingly, the biting section 26*b* of each metal press fitting portion 26*a* bites into and comes in pressure contact with the inner circumferential surface of the corresponding first insertion hole 28 of the case main body 7 made of a synthetic resin. As a result, the press fitting portion 26*a* of each fastening member 23 is reliably and firmly fixed in the corresponding first insertion hole 28 of the case main body 7 without rattling in the direction perpendicular to the axial direction of the fastening members 23.

In addition, the biting section 26*b* of each press fitting portion 26*a* is a knurled section where a number of peak portions and a number of valley portions extending in the axis direction have been alternately formed by knurling. Accordingly, when the press fitting portions 26*a* are pressed into the first insertion holes 28, a number of peak portions of the biting section 26*b* of each press fitting portion 26*a* unfailingly bite into the inner circumferential surface of the corresponding first insertion hole 28 by the presence of the valley portions. By this structure as well, the press fitting portions 26*a* are reliably and firmly fixed in the first insertion holes 28 of the case main body 7 without rattling in the direction perpendicular to the axial direction of the fastening members 23.

Also, since the inner diameter of each second insertion hole 29 of the first exterior case 15 is equal to the outer diameter of the fitting portion 27 of the corresponding fastening member 23 and no fitting tolerance exists between each second insertion hole 29 and the corresponding fitting portion 27, that is, the fitting tolerance therebetween is 0 (zero), each fitting portion 27 is tightly fitted into the corresponding second insertion hole 29 of the first exterior case 15. If the axial center of each second insertion hole 29 and that of the corresponding first insertion hole 28 are at positions shifted from each other, the corresponding fitting portion 27 is fitted into the second insertion hole 29 while being press-deformed in proportion to this position deviation by the presence of its hollow section 27*a*.

As a result of this structure, the fitting portions 27 are reliably and firmly fixed in the second insertion holes 29 of the first exterior case 15 without rattling in the direction perpendicular to the axial direction of the fastening members 23. Also, the metal first exterior case 15 has the structure where the reinforcement projections 21 have been provided on the exterior main body 18 that is arranged on the case main body 7, and the second insertion holes 29 have been provided in the reinforcement projections 21. Accordingly, when the metal fitting portions 27 are being fitted into the second insertion holes 29, the second insertion holes 29 are not deformed. Here, the fitting portions 27 are press-deformed to be fitted thereinto.

As a result of this structure, even if the wristwatch case 1 is subjected to an external impact, the first exterior case 15 does not rattle with respect to the case main body 7 in the direction perpendicular to the axial direction of the fastening members 23. That is, the position of the first exterior case 15 with respect to the case main body 7 is not shifted in the direction perpendicular to the axial direction of the fastening members 23.

Therefore, loads resulting from the position deviation of the first exterior case 15 with respect to the case main body 7 are not applied to the case main body 7 via the fastening members 23. As a result, even if the wristwatch case 1 is subjected to an external impact, the case main body 7 is prevented from being damaged by the impact. That is, its impact resistance is enhanced.

Also, as for the fastening members 23, their press fitting portions 26*a* are press-fitted into the plurality of first insertion holes 28 provided in four portions of the side parts of the case main body 7 on the three o'clock side and the seven o'clock side, and their fitting portions 27 are fitted into the plurality of second insertion holes 29 provided in four portions of the side parts of the first exterior case 15 on the three o'clock side and the seven o'clock side. By this presence of the press fitting portions 26*a* and the fitting portions 27, the impact resistance is further enhanced.

As described above, this wristwatch case 1 includes the case main body 7 which has the first insertion holes 28, the first exterior case 15 which has the second insertion holes 29 coaxially corresponding to the first insertion holes 28 and is arranged on the upper part of the case main body 7, and the fastening members 23 which have the fixing portions 26 to be fixed in the first insertion holes 28 and the fitting portions 27 to be fitted into the second insertion holes 29. Each fitting portion 27 is fitted into the corresponding second insertion hole 29 while deforming its portion to be fitted thereinto, and thereby prevents the rattling of the first exterior case 15 due to impacts, whereby the case main body 7 is prevented from being damaged by impacts and its impact resistance is enhanced.

That is, in this wristwatch case 1, the fixing portions 26 of the fastening members 23 are fixed in the first insertion holes 28 of the case main body 7, and the fitting portions 27 of the fastening members 23 are fitted into and fixed in the second insertion holes 29 of the first exterior case 15 while deforming their portions to be fitted thereinto. Therefore, even if the wristwatch case 1 is subjected to an external impact, the first exterior case 15 does not rattle with respect to the fitting portions 27 of the fastening members 23 in the direction perpendicular to the axial direction of the fastening members 23.

Accordingly, in this wristwatch case 1, the position of the first exterior case 15 with respect to the case main body 7 is not shifted in the direction perpendicular to the axial direction of the fastening members 23 even when it is subjected to an impact, whereby loads resulting from the position deviation of the first exterior case 15 with respect to the case main body 7 are not applied to the case main body 7 via the fastening members 23. As a result, the case main body 7 is prevented from being damaged and its impact resistance is enhanced.

Also, this wristwatch case 1 is structured such that the length of the fitting portion 27 of each fastening member 23 in the radial direction after the fitting portions 27 are inserted into the second insertion holes 29 is shorter than that before the fitting portions 27 are inserted into the second insertion holes 29. That is, when the fitting portions 27 are fitted into the second insertion holes 29 of the first exterior case 15, the outer circumferential surface of each fitting portion 27 comes in close contact with the inner circumferential surface of the corresponding second insertion hole 29. As a result of this structure, the fitting portions 27 can be unfailingly and favorably fitted into the second insertion holes 29 and firmly fixed therein.

Moreover, in this wristwatch case 1, the fixing portions 26 of the fastening members 23 which are fixed in the first insertion holes 28 include the press fitting portions 26*a* that are press-fitted into the first insertion holes 28. By these press fitting portions 26*a* being firmly fixed in the first insertion holes 28 of the case main body 7 by press fitting, the rattling of the first exterior case 15 with respect to the case main body 7 due to impacts can be reliably prevented.

Furthermore, in this wristwatch case 1, the press fitting portions 26*a* of the fastening members 23 include the biting sections 26*b* which bite into the inner circumferential surfaces of the first insertion holes 28 of the case main body 7. Accordingly, when the press fitting portions 26*a* are being pressed into the first insertion holes 28 of the case main body 7, the biting sections 26*b* of these press fitting portions 26*a* bite into the inner circumferential surfaces of the first insertion holes 28. As a result, the press fitting portions 26*a* do not rattle in the direction perpendicular to the axial direction, and can be press-fitted into and fixed in the first insertion holes 28 reliably and firmly.

Thus, in this wristwatch case 1, the position of the first exterior case 15 with respect to the case main body 7 is not shifted in the direction perpendicular to the axial direction of the fastening members 23 even when it is subjected to an impact. By this structure as well, loads resulting from the position deviation of the first exterior case 15 are not applied to the case main body 7 via the fastening members 23. As a result, the case main body 7 is prevented from being damaged by impacts and its impact resistance is further enhanced.

Also, in this wristwatch case 1, the biting section 26*b* of each press fitting portion 26*a* is a knurled section formed by knurling. These biting sections 26*b* can be easily formed on the outer circumferential surfaces of the press fitting portions 26*a* by knurling. When the press fitting portions 26*a* are being pressed into the first insertion holes 28 of the case main body 7, these biting sections 26*b* of the press fitting portions 26*a* favorably bite into the inner circumferential surfaces of the first insertion holes 28 of the case main body 7.

More specifically, the biting section 26*b* of each press fitting portion 26*a* is a knurled section where a number of peak portions and a number of valley portions extending in the axis direction of the fastening members 23 have been alternately formed by knurling. Accordingly, when the press fitting portions 26*a* are being pressed into the first insertion holes 28 of the case main body 7, a number of peak portions of the biting section 26*b* of each press fitting portion 26*a* unfailingly and favorably bite into the inner circumferential surface of the corresponding first insertion hole 28 of the case main body 7 by the presence of the valley portions. By this structure, the press fitting portions 26*a* can be unfailingly and favorably press-fitted into the first insertion holes 28.

Also, on the leading ends of the press fitting portions 26*a* in their insertion direction toward the first insertion holes 28, the tapered sections 26*c* are provided. Accordingly, by the leading ends of the tapered sections 26*c* being inserted into the first insertion holes 28, the press fitting portions 26*a* can be guided when they are pressed into the first insertion holes 28 of the case main body 7. As a result, the press fitting portions 26*a* are easily and unfailingly pressed into the first insertion holes 28 of the case main body 7, which improves the efficiency of the operations of pressing the press fitting portions 26*a* into the first insertion holes 28.

In the case of this wristwatch case 1, the outer diameter of the press fitting portion 26*a* of each fastening member 23 is formed greater than the outer diameter of each fitting portion 27, and the inner diameter of each first insertion hole 28 of the case main body 7 is formed shorter than the outer diameter of each press fitting portion 26*a* by a length equal to the biting of each biting section 26*b* with respect to the inner circumferential surface of the corresponding first insertion hole 28. As a result, when the press fitting portions 26*a* of the fastening members 23 are being attached to the first insertion holes 28 of the case main body 7, the biting section 26*b* of each press fitting portion 26*a* can unfailingly and favorably bite into the inner circumferential surface of the corresponding first insertion hole 28 of the case main body 7 so as to press-fit the press fitting portions 26*a* into the first insertion holes 28.

Also, in the case of this wristwatch case 1, the inner diameter of each second insertion hole 29 of the first exterior case 15 is equal to the outer diameter of the corresponding fitting portion 27 and no fitting tolerance exists between each second insertion hole 29 and the corresponding fitting portion 27, that is, the fitting tolerance therebetween is 0 (zero). As a result, the fitting portions 27 of the fastening members 23 can be unfailingly and favorably fitted into the second insertion holes 29 of the first exterior case 15 while being in close contact with the inner circumferential surfaces of the second insertion holes 29. Also, even if the axial center of each second insertion hole 29 and that of the corresponding first insertion hole 28 are at positions shifted from each other, the corresponding fitting portion 27 can be reliably and favorably fitted into the second insertion hole 29 by being press-deformed.

Moreover, in the case of this wristwatch case 1, the case main body 7 is formed of a synthetic resin. Accordingly, when the press fitting portions 26*a* of the fastening members 23 are being attached to the first insertion holes 28 of the case main body 7, the biting section 26*b* of each press fitting portion 26*a* can unfailingly and favorably bite into the inner circumferential surface of the corresponding first insertion hole 28 of the case main body 7 which is made of a synthetic resin.

Furthermore, in the case of this wristwatch case 1, the first exterior case 15 is formed of a metal which is more rigid than the case main body 7. Accordingly, when the fitting portions 27 of the fastening members 23 are to be attached to the second insertion holes 29 of the first exterior case 15, these fitting portions 27 can be unfailingly and favorably fitted into the second insertion holes 29 of the metal first exterior case 15 while being press-deformed.

Still further, in this wristwatch case 1, the fitting portions 27 include the hollow sections 27*a* which enable the fitting portions 27 to be press-deformed. Accordingly, even if the axial center of each second insertion hole 29 and that of the corresponding first insertion hole 28 are at positions shifted from each other when the fitting portions 27 are fitted into the second insertion holes 29 of the first exterior case 15, the fitting portions 27 can be unfailingly and favorably press-deformed by the presence of the hollow sections 27*a*. As a result of this structure, the fitting portions 27 can be unfailingly and favorably fitted into the second insertion holes 29 while being in close contact with the inner circumferential surfaces of the second insertion holes 29.

Yet still further, in this wristwatch case 1, the reinforcement projections 21 having the second insertion holes 29 are provided on the first exterior case 15 while projecting toward the case main body 7. As a result, the second insertion holes 29 into which the fitting portions 27 of the fastening members 23 are fitted are reinforced by the reinforcement projections 21, whereby the strength is enhanced. As a result of this structure, when being fitted into the second insertion holes 29 of the first exterior case 15, the fitting portions 27 can be unfailingly and favorably press-deformed by the reinforcement projections 21.

Also, on the case main body 7, the engaging recess sections 14 where the reinforcement projections 21 are arranged are provided, and the first insertion holes 28 are provided in these engaging recess sections 14. Accordingly, even though the first exterior case 15 is provided with the reinforcement projections 21 for reinforcing the second insertion holes 29, these reinforcement projections 21 can be arranged in the engaging recess sections 14 of the case main body 7. In this embodiment, by the protection covers 10 for the engaging recess sections 14 on the three o'clock side and the decorative projection 11 for the engaging recess section 14 on the nine o'clock side, the design of the wristwatch case 1 can be enhanced.

Also, in this wristwatch case 1, the first insertion holes 28 are provided corresponding to portions that project from the outer circumferential portion of the case main body 7, such as each protection cover 10 on the three o'clock side and the decorative projection 11 on the nine o'clock side. Therefore, even though the first insertion holes 28 into which the press fitting portions 26*a* of the fastening members 23 are press-fitted are provided in the case main body 7, the strength of the case main body 7 can be maintained by the protection covers 10 on the three o'clock side and the decorative projection 11 on the nine o'clock side which are the portions that project from the outer circumferential portion of the case main body 7.

That is, in this wristwatch case 1, portions that project from the outer circumferential portion of the case main body 7 serve as the protection covers 10 for protecting the button head section 3*a* of the switch device 3 provided on the three o'clock side of the case main body 7. As a result, the button head section 3*a* of this switch device 3 can be favorably protected by the protection covers 10 and the strength of portions of the case main body 7 corresponding to the first insertion holes 28 into which the corresponding press fitting portions 26*a* are press-fitted can be maintained.

Moreover, in this wristwatch case 1, a portion that projects from the outer circumferential portion of the case main body 7 serves as the decorative projection 11 on the nine o'clock side of the case main body 7. By this decorative projection 11, the strength of portions of the case main body 7 corresponding to the other first insertion holes 28 into which the corresponding press fitting portions 26*a* are press-fitted can be maintained, and the decoration can be improved to provide a high design project.

Also, the fastening members 23 of the wristwatch case 1 include the fixing portions 26 which are fixed in the first insertion holes 28 of the case main body 7 serving as a first component, and the fitting portions 27 which are fitted into the second insertion holes 29 that are provided in the first exterior case 15 serving as a second component to be arranged on the upper part of the case main body 7 serving as the first component and are coaxially corresponding to the first insertion holes 28. Each fitting portion 27 is fitted into the corresponding second insertion hole 29 while deforming its portion to be fitted thereinto. As a result of this structure, the first exterior case 15 is prevented from rattling with respect to the case main body 7 in the direction perpendicular to the axial direction of the fastening members 23, whereby the case main body 7 is prevented from being damaged and the impact resistance is enhanced.

In the above-described embodiment, the fitting portions 27 are provided with the hollow sections 27*a* so as to be easily deformed. However, the present invention is not limited thereto and a structure may be adopted in which the fitting portions 27 are provided with grooves so as to be easily deformed, or are made of an easily deformed material such as aluminum.

Also, in the above-described embodiment, the case main body 7 is made of a synthetic resin. However, the present invention is not limited thereto. For example, a structure may be adopted in which the case main body 7 is made of a flexible metal such as aluminum or a highly rigid metal such as stainless steel.

Moreover, in the above-described embodiment, the biting section 26*b* of each press fitting portion 26*a* is a knurled section where a number of peak portions and a number of valley portions extending in the axis direction of the fastening members 23 have been alternately formed by knurling. However, the present invention is not limited thereto and a structure may be adopted in which each biting section 26*b* is a knurled section where peak portions and valley portions have been formed in a meshed pattern by knurling, or an uneven section where a number of small projections have been provided.

Furthermore, in the above-described embodiment, the second exterior case 17 is made of a metal such as stainless steel. However, the present invention is not limited thereto and a structure may be adopted in which the second exterior case 17 is made of a synthetic resin such as urethane resin or a synthetic resin acquired by carbon fiber or glass fiber being mixed into polyamide resin.

Still further, in the above-described embodiment, the first exterior case 15 is made of metal. However, a structure may be adopted in which portions around each second insertion hole 29 of the first exterior case 15 are made of metal and the other portions are made of a material other than metal.

Yet still further, in the above-described embodiment, the spacer member 16 is made of a synthetic resin such as urethane resin. However, the present invention is not limited thereto and a structure may be adopted in which the spacer member 16 is made of a synthetic resin acquired by carbon fiber or glass fiber being mixed into polyamide resin.

Yet still further, in the above-described embodiment, the present invention has been applied in a wristwatch. However, the present invention is not necessarily required to be applied in a wristwatch. For example, the present invention is applicable to various types of timepieces such as a travel watch, an alarm clock, a table clock, and a wall clock.

In addition, the present invention is not necessarily required to be applied in timepieces, and is applicable to electronic devices such as a cell phone and a portable information terminal.

While the embodiments have been described, it is intended that the invention be not limited by any of the details of the description therein but includes all the embodiments which fall within the scope of the appended claims.

What is claimed is:

1. A case comprising:

a case main body which has a first insertion hole;

a first exterior case which has a second insertion hole coaxially corresponding to the first insertion hole and is arranged on an upper part of the case main body; and a fastening member which has (i) a fixing portion to be fixed in the first insertion hole and (ii) a fitting portion to be fitted into the second insertion hole, wherein the fitting portion is fitted into the second insertion hole while deforming a portion of the fitting portion to be fitted into the second insertion hole, wherein the fixing portion of the fastening member which is fixed in the first insertion hole includes a press fitting portion which is press-fitted into the first insertion hole, and wherein the press fitting portion of the fastening member includes a biting portion which bites into an inner circumferential surface of the first insertion hole of the case main body.

2. The case according to claim 1, wherein a length of the fitting portion of (Original) the fastening member in a radial direction after the fitting portion is inserted into the second insertion hole is shorter than a length of the fitting portion in the radial direction before the fitting portion is inserted into the second insertion hole.

3. The case according to claim 1, wherein the biting portion is a knurled portion provided by knurling.

4. The case according to claim 1, wherein the press fitting portion has a tapered portion provided on a leading end thereof in an insertion direction toward the first insertion hole.

5. The case according to claim 1, wherein the fastening member is formed such that an outer diameter of the press fitting portion is greater than an outer diameter of the fitting portion, wherein the first insertion hole is formed such that an inner diameter thereof is shorter than the outer diameter of the press fitting portion by a length equal to biting of the biting portion with respect to the inner circumferential surface of the first insertion hole, and wherein the second insertion hole is formed such that an inner diameter thereof is equal to the outer diameter of the fitting portion, and no fitting tolerance exists between the second insertion hole and the fitting portion.

6. The case according to claim 1, wherein the case main body is formed of a synthetic resin, and the exterior case is formed of a metal that is more rigid than the case main body.

7. The case according to claim 1, wherein the fitting portion includes a hollow portion which enables the fitting portion to be press-deformed.

8. The case according to claim 1, wherein the exterior case has a reinforcement projection which is provided projecting toward the case main body and in which the second insertion hole is provided, and wherein the case main body is provided with an engaging recess where the reinforcement projection is arranged, and the engaging recess is provided with the first insertion hole.

9. The case according to claim 1, wherein the first insertion hole is provided corresponding to a portion that projects from an outer circumferential portion of the case main body.

10. The case according to claim 9, wherein the portion that projects from the outer circumferential portion of the case main body is a protection cover which protects a switch provided on the case main body.

11. A timepiece comprising the case according to claim 1.

12. A fastening member comprising:

a fixing portion which is fixed in a first insertion hole in a first component; and a fitting portion which is fitted into a second insertion hole that is provided in a second component to be arranged on an upper part of the first component while coaxially corresponding to the first insertion hole, wherein the fitting portion is fitted into the second insertion hole while deforming a portion of the fitting portion to be fitted into the second insertion hole, wherein the fixing portion includes a press fitting portion which is press-fitted into the first insertion hole, and wherein the press fitting portion has a tapered portion provided on a leading end thereof in an insertion direction toward the first insertion hole.

13. The case according to claim 6, wherein the synthetic resin is at least one of a urethane resin and a synthetic resin acquired by carbon fiber or glass fiber being mixed into polyamide resin, and wherein the metal is stainless steel.

14. The timepiece comprising the case according to claim 11, wherein the timepiece is one of a travel watch, an alarm clock, a table clock, and a wall clock.

* * * * *